US008061875B2

(12) United States Patent
Zhang

(10) Patent No.: US 8,061,875 B2
(45) Date of Patent: Nov. 22, 2011

(54) LED LAMP

(75) Inventor: Wen-Xiang Zhang, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 408 days.

(21) Appl. No.: 12/397,354

(22) Filed: Mar. 4, 2009

(65) Prior Publication Data

US 2010/0080004 A1 Apr. 1, 2010

(51) Int. Cl.
*F21V 29/00* (2006.01)

(52) U.S. Cl. ..... 362/294; 362/218

(58) Field of Classification Search ..... 362/218, 362/225, 249.02, 294, 296.01, 311.02
See application file for complete search history.

(56) References Cited

U.S. PATENT DOCUMENTS

| | | | | |
|---|---|---|---|---|
| 2008/0002399 | A1 * | 1/2008 | Villard et al. | 362/184 |
| 2008/0080162 | A1 * | 4/2008 | Wilcox et al. | 362/20 |
| 2008/0089072 | A1 | 4/2008 | Kim et al. | |
| 2009/0303712 | A1 * | 12/2009 | Wung et al. | 362/234 |
| 2009/0310372 | A1 * | 12/2009 | Zhou et al. | 362/373 |
| 2009/0323324 | A1 * | 12/2009 | Liu | 362/234 |

* cited by examiner

*Primary Examiner* — David V Bruce
(74) *Attorney, Agent, or Firm* — Altis Law Group, Inc.

(57) ABSTRACT

An LED lamp includes a housing defining a window therein, a cover engaging the housing, a heat sink fixed on the cover and completely received in the housing, an LED module attached to the heat sink and facing the window of the housing, and a lens engaging the window of the housing.

18 Claims, 7 Drawing Sheets

LED LAMP

BACKGROUND OF THE INVENTION

1. Field of the Invention

The present disclosure relates to LED (light emitting diode) lamps and, more particularly, to an improved LED lamp having a novel structure for use outdoors.

2. Description of Related Art

LED lamp, a solid-state lighting, utilizes LEDs as a source of illumination, providing advantages such as resistance to shock and nearly limitless lifetime under specific conditions. Thus, LED lamps present a cost-effective yet high quality replacement for incandescent and fluorescent lamps.

Known implementations of LED modules in an LED lamp make use of a plurality of individual LEDs to generate sufficient light. The large number of LEDs leads to a more expensive module and one with greater power consumption. The greater power usage leads to greater heat output, which, if not adequately addressed, impacts LED lamp reliability. Therefore, various heat dissipation devices with complicated structures are exploited in the LED lamp, increasing the difficulty and cost of manufacturing the LED lamp.

What is needed, therefore, is an LED lamp with simple structure, suitable to mass-manufacture, and having satisfactory heat dissipation capability.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION OF THE INVENTION

Figure 1:
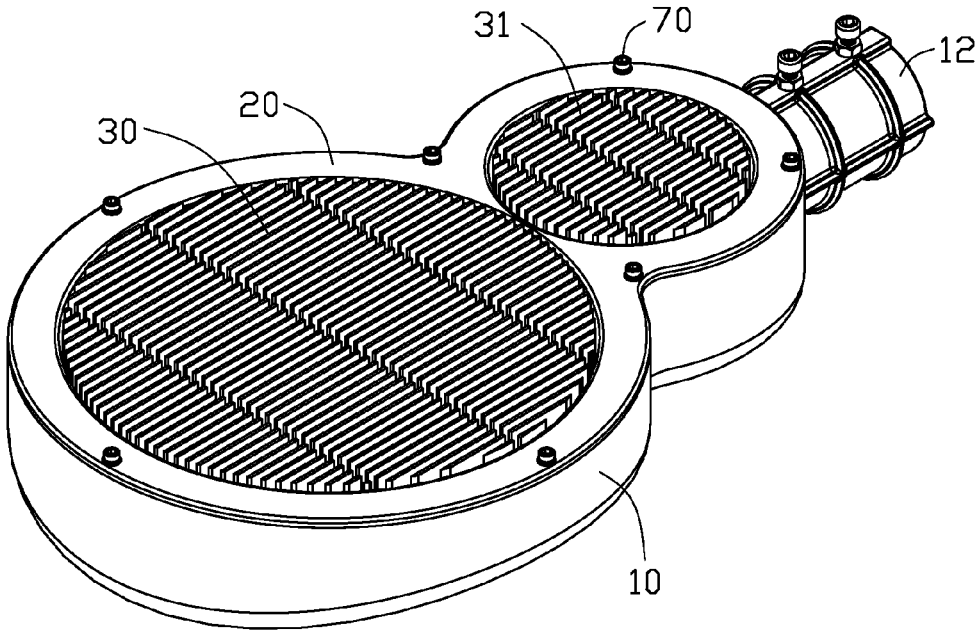
FIG. 1 is an isometric, assembled view of an LED lamp in accordance with a first embodiment of the present disclosure.
Figure 2:
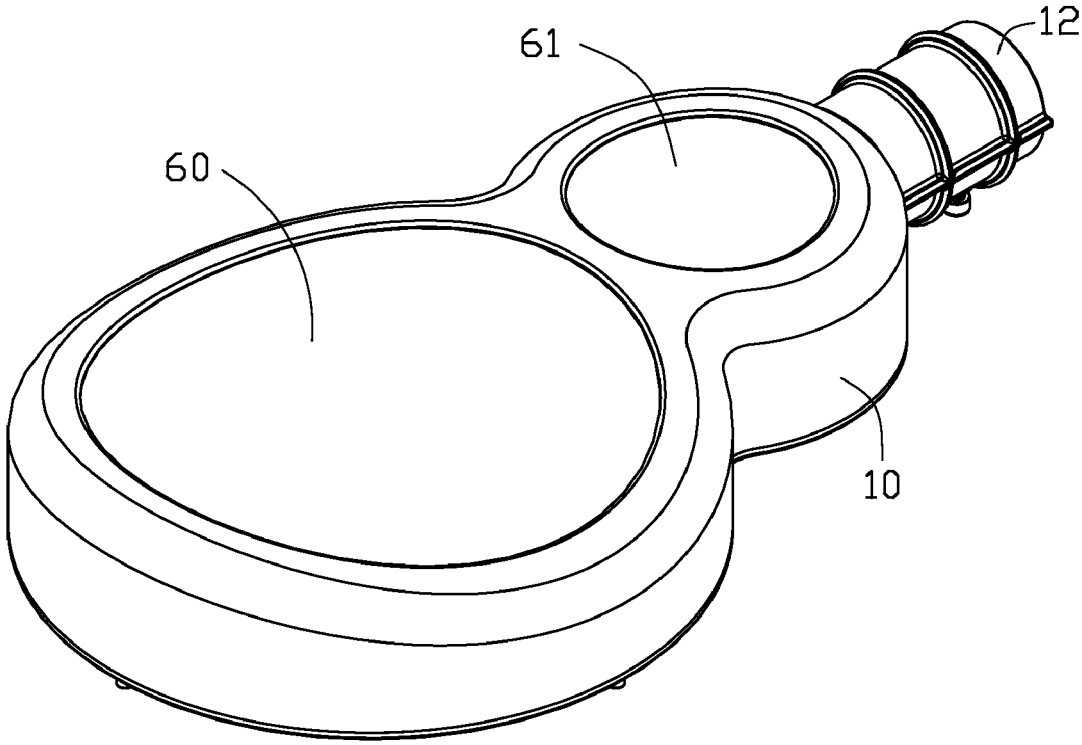
FIG. 2 is an inverted view of the LED lamp in FIG. 1.

Referring to FIGS. 1-4, an LED lamp in accordance with a first embodiment is illustrated. The LED lamp comprises a substrate 10, a cover 20 engaging the substrate 10, a first heat sink 30 and a second heat sink 31 received in the substrate 10 and engaging the cover 20, and a first LED module 40 and a second LED module 41 attached to the first and second heat sinks 30, 31, respectively. The LED lamp further comprises a first reflector 50 and a second reflector 51 respectively reflecting light generated by the first and second LED modules 40, 41, and a first lens 60 and a second lens 61 engaging the substrate 10.

Figure 3:
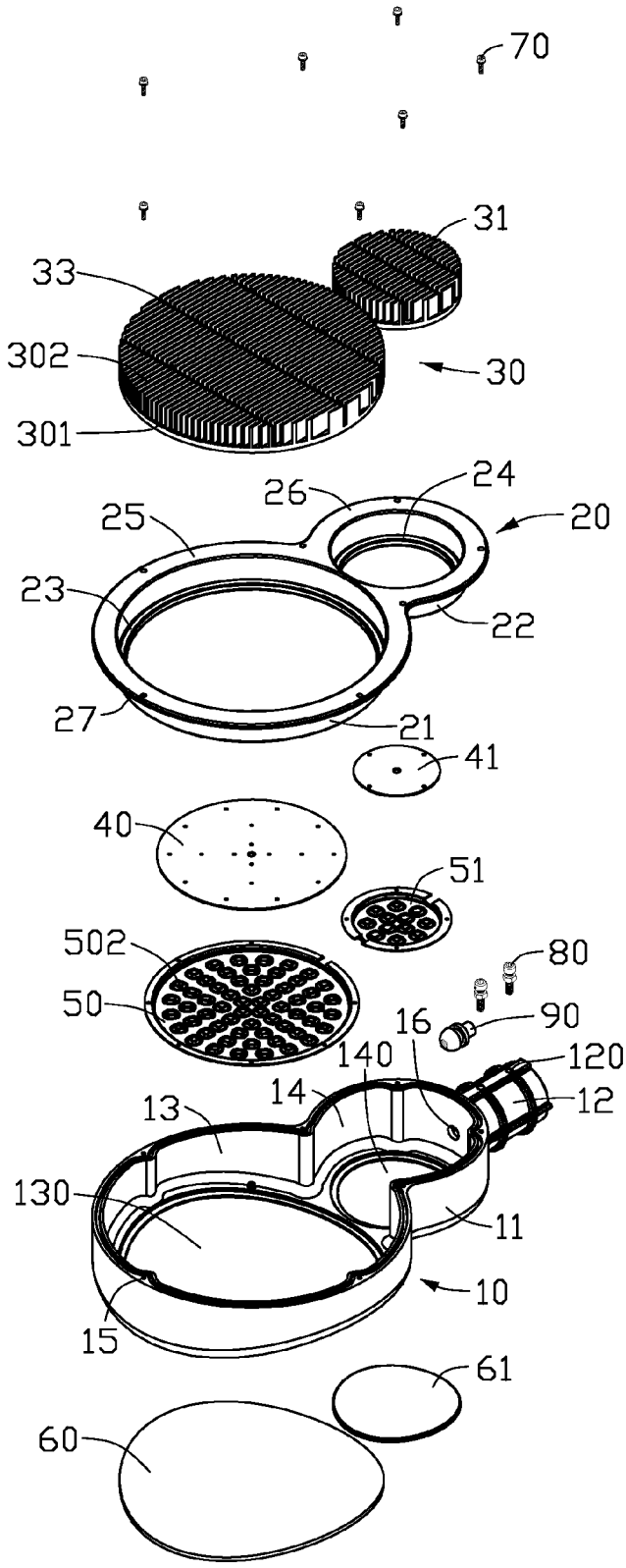
FIG. 3 is an exploded view of the LED lamp in FIG. 1.
Figure 4:
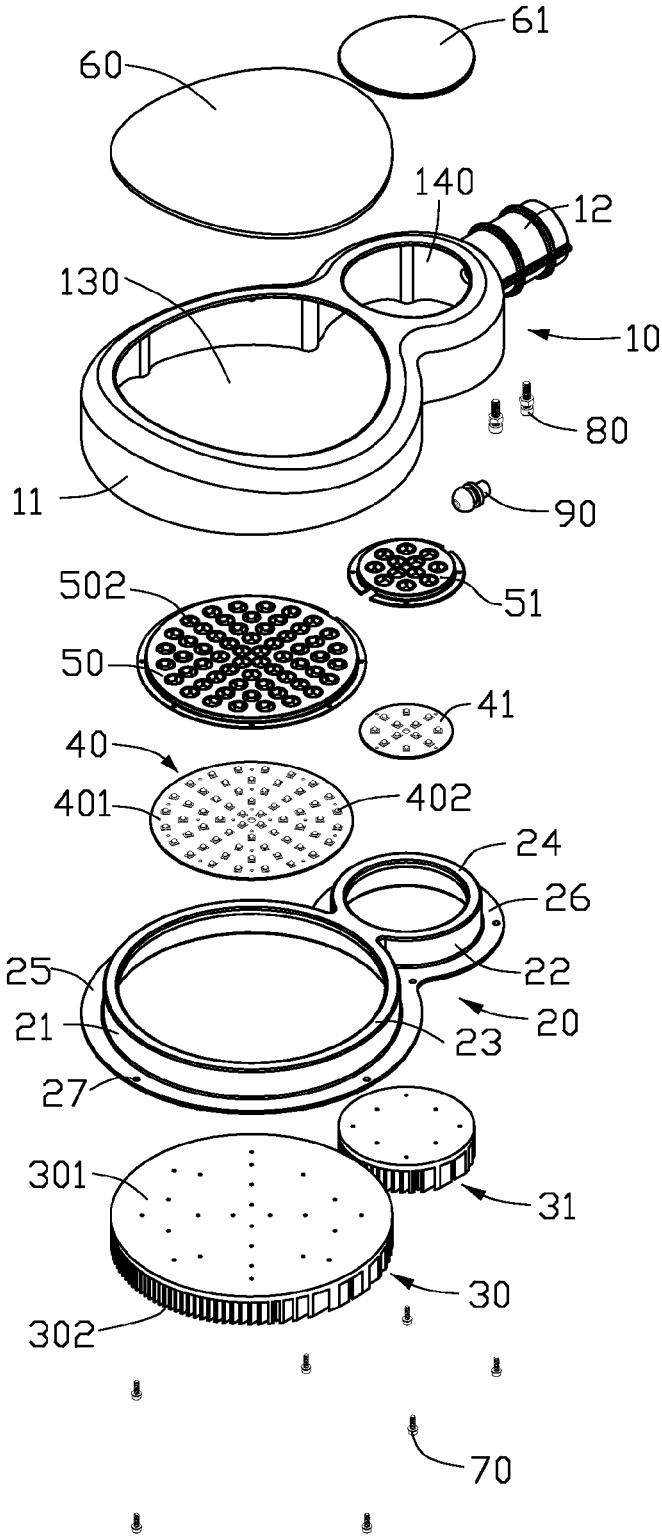
FIG. 4 is an exploded view of the LED lamp in FIG. 2.

Referring to FIGS. 3 and 4, the substrate 10 substantially forms a bifurcated figure-8. The substrate 10 comprises a housing 11 with open top and bottom ends, and a supporting bar 12 extending from a rear end of the housing 11. A first chamber 13 and a second chamber 14 are defined with different sizes in the housing 11 and communicate with each other. Specifically, the first chamber 13 is larger than the second chamber 14, with both substantially columned. A first window 130 and a second window 140 are defined in the bottom end of the housing 11 corresponding to the first and second chambers 13, 14, respectively. A plurality of threaded holes 15 are defined in the top end of the housing 11. A through hole 16 is defined in the rear end of the housing 11 to communicate with the second chamber 14 and the supporting bar 12. A waterproof plug 90 is received in the hole 16 to prevent fluid from entering the housing 11. Leading wires (not shown) can extend through the waterproof plug 90 and to the first and second LED modules 40, 41, providing power thereto. Two positioning screws 80 are accommodated in two holes 120 of the supporting bar 12 for threadedly engaging into a supporting post (now shown) connecting with the supporting bar 12 to thereby fix the LED lamp to the supporting post.

The cover 20 also substantially forms a bifurcated figure-8, corresponding to the housing 11 of the substrate 10. The cover 20 comprises two columned walls 21, 22 of different sizes, i.e., a first wall 21 and a second wall 22. A first ring-shaped supporting plate 23 extends inwardly and horizontally from a bottom end of the first wall 21, and a first connecting plate 25 extends outwardly and horizontally from a top end of the first wall 21. A second ring-shaped supporting plate 24 extends inwardly and horizontally from a bottom end of the second wall 22, and a second connecting plate 26 extends outwardly and horizontally from a top end of the second wall 22. The first wall 21 corresponds to the first chamber 13 of the housing 11, and the second wall 22 corresponds to the second chamber 14. The first wall 21 is larger than the second wall 22. The first wall 21 is tangential to the second wall 22, and the first and second supporting plates 23, 24 at bottom ends of the first and second walls 21, 22 are combined. More particularly, no connecting plates 25, 26 are disposed at the conjunction of the first and second walls 21, 22 due to tangency therebetween. The first and second connecting plates 25, 26 extend outwardly from part of the top ends of the first and second walls 21, 22 other than the conjunction portion thereof. A plurality of through holes 27 are defined in the first and second connecting plates 25, 26. Screws 70 extend through the holes 27 of the first and second connecting plates 25, 26 and into the holes 15 of the housing 11 to engage the substrate 10 and the cover 20.

The first heat sink 30 and the second heat sink 31 have the same configuration, with the first heat sink 30 larger than second heat sink 31. Each of the first and second heat sinks 30, 31 comprises a round base 301 with a plurality of plate fins 302 extending from a top surface thereof. The first and second heat sinks 30, 31 are the same height as the first and second walls 21, 22 of the cover 20. A plurality of parallel spaced channels 33 are defined in and perpendicular to the fins 302. The first heat sink 30 is arranged on the first supporting plate 23 of the cover 20, and the second heat sink 31 is arranged on the second supporting plate 24 of the cover 20.

The first LED module 40 and the second LED module 41 have a same configuration, with the first LED module 40 being larger than the second LED module 41. Each of the first and second LED modules 40, 41 comprises a mounting board 401 and a plurality of LEDs 402 radially mounted thereon. The first LED module 40 is attached to a bottom surface of the base 301 of the first heat sink 30. The second LED module 41 is attached to a bottom surface of the base 301 of the second heat sink 31.

The first and second reflectors 50, 51 are respectively mounted on the first and second LED modules 40, 41 and fixed to the bottom surfaces of the bases 301 of the first and second heat sinks 30, 31. A plurality of apertures 502 are defined in the first and second reflectors 50, 51. Each aperture 502 corresponds to an LED 402.

The first and second lenses 60, 61 are transparent or semi-transparent material such as glass, plastic, or other, allowing light emitted by the first and second LED modules 40, 41 to project therethrough to illuminate the surrounding environment. The first and second lenses 60, 61 are respectively fixed to the first and second windows 130, 140 of the housing 11.

In assembly, the first and second lenses 60, 61 respectively engage the first and second windows 130, 140 of the housing 11. The first LED module 40 and the first reflector 50 are fixed to the bottom surface of the base 301 of the first heat sink 30, and the second LED module 41 and the second reflector 51 are fixed to the bottom surface of the base 301 of the second heat sink 31. The first heat sink 30 assembled with the first LED module 40 and the first reflector 50 is fixed to the first supporting plate 23 of the cover 20. The second heat sink 31 assembled with the second LED module 41 and the second reflector 51 is fixed to the second supporting plate 24 of the cover 20. The cover 20 assembled with the first and second heat sinks 30, 31, the first and second LED modules 40, 41 and the first and second reflectors 50, 51 engages the housing 11 by the screws 70 extending through the holes 27 of the cover 20 and into the holes 15 of the housing 11. The first and second walls 21, 22 and the first and second supporting plates 23, 24 are received in the housing 11. The first heat sink 30, the first LED module 40 and the first reflector 50 are received in the first chamber 13 of the housing 11. The second heat sink 31, the second LED module 41 and the second reflector 51 are received in the second chamber 14 of the housing 11. The first and second LED modules 40, 41 face the first and second windows 130, 140, respectively. Tops of the fins 302 of the first and second heat sinks 30, 31 and the first and second connecting plates 25, 26 of the cover 20 are coplanar; that is, the first and second heat sinks 30, 31 are completely received in the cover 20, as well in the housing 11.

In operation, light generated by the first and second LED modules 30, 31 projects through the first and second lenses 60, 61 and towards the outside of the housing 11. The first and second heat sinks 30, 31 absorb heat from the first and second LED modules 40, 41 for dissipation into the ambient air. The first and second heat sinks 30, 31 accommodated in the cover 20 further serve as protective components preventing external fluid and solid contaminants from entry into housing 11. Further, since the first and second heat sinks 30, 31 are completely received in the housing 11, the fins 302 of the first and second heat sinks 30, 31 remain contained within the housing 11, such that aesthetic appearance of the LED lamp is maintained. The first and second heat sinks 30, 31 completely received in the housing 11, also reduce the volume of the LED lamp, thus to enhance portability and ease of assembly and disassembly of the LED lamp.

Figure 5:
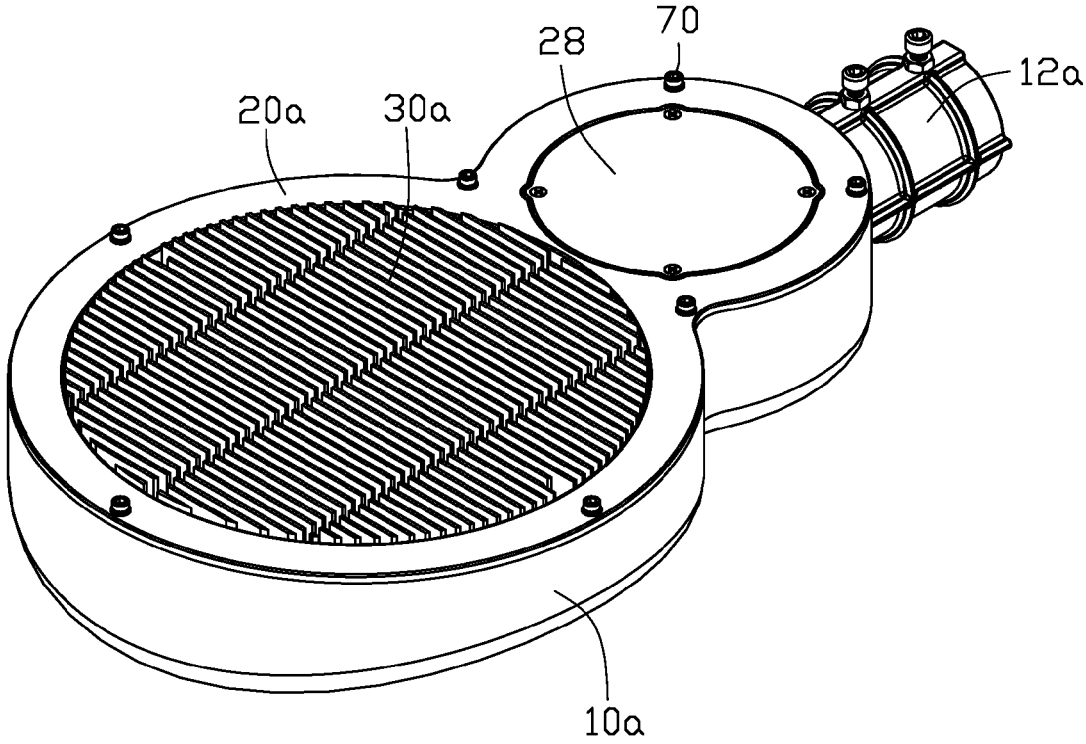
FIG. 5 is an isometric, assembled view of an LED lamp in accordance with a second embodiment of the present disclosure.
Figure 6:
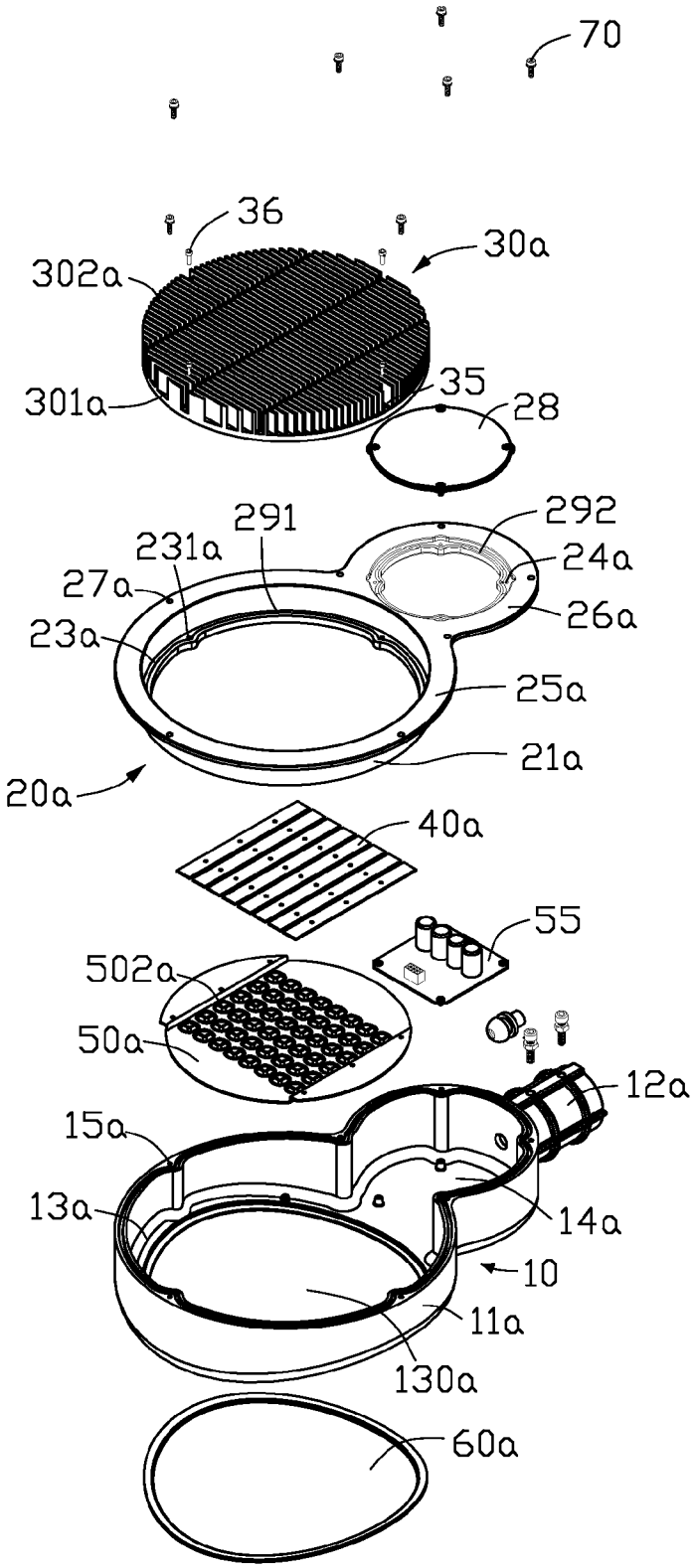
FIG. 6 is an exploded view of the LED lamp in FIG. 5.
Figure 7:
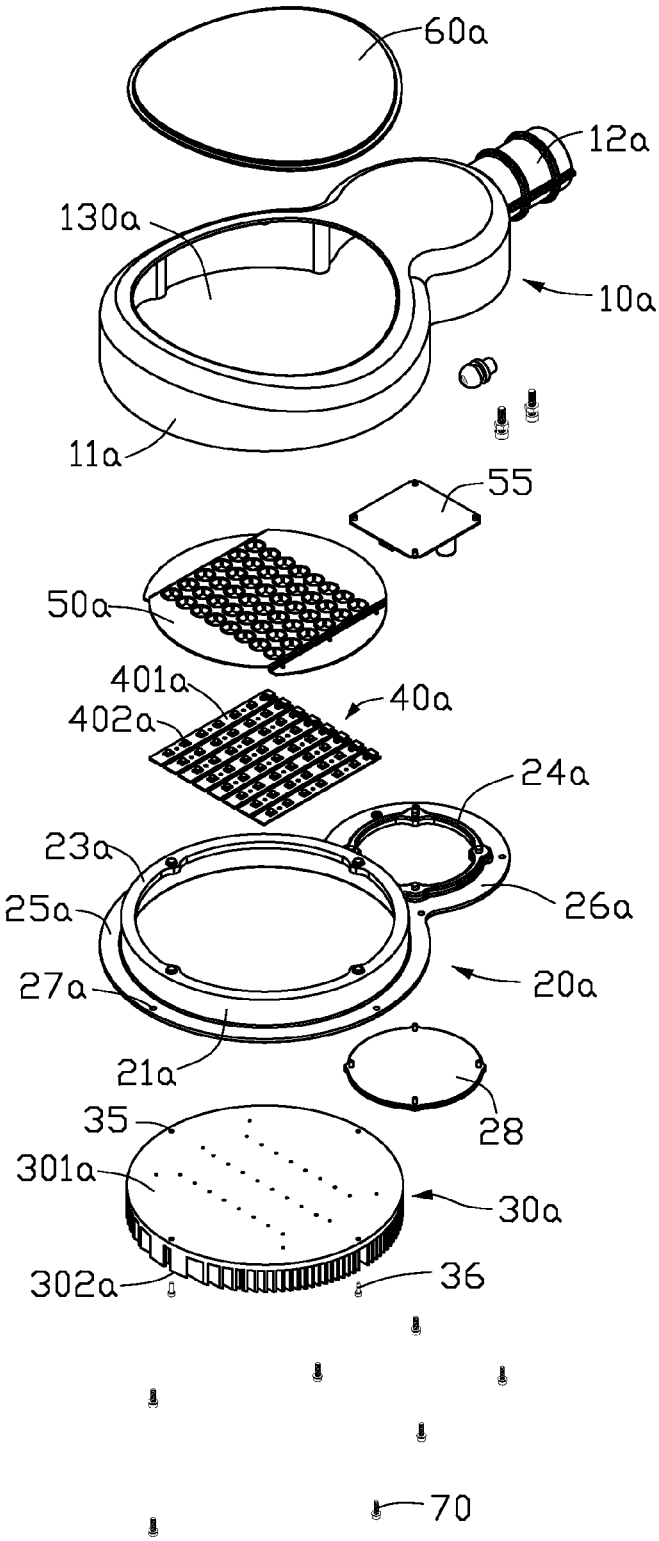
FIG. 7 is an inverted view of the LED lamp in FIG. 6.

Referring to FIGS. 5-7, an LED lamp in accordance with a second embodiment is illustrated. The LED lamp comprises a substrate 10*a*, a cover 20*a* engaging the substrate 10*a*, a heat sink 30*a* received in the substrate 10*a* and engaging the cover 20*a*, and an LED module 40*a* attached to the heat sink 30*a*. The LED lamp further comprises a reflector 50*a* mounted on the LED module 40*a*, a lens 60*a* engaging the substrate 10*a*, and a rectifier 55 electrically connected with the LED module 40*a* and received in the substrate 10*a*.

The substrate 10*a* is similar to the substrate 10 of the LED lamp in the previous embodiment, and substantially forms a bifurcated figure-8. The substrate 10*a* comprises a housing 11*a* and a supporting bar 12*a* extending from a rear end of the housing 11*a*. The housing 11*a* differs from housing 11 only in that a window 130*a* is defined in a bottom end of the housing 11*a* corresponding to a first chamber 13*a*, where a bottom end of the housing 11*a* corresponding to a second chamber 14*a* is closed. The first chamber 13*a* is larger than the second chamber 14*a*. The heat sink 30*a*, the LED module 40*a* and the reflector 50*a* are received in the first chamber 13*a*. The rectifier 55 is received in the second chamber 14*a*.

The cover 20*a* comprises a columned wall 21*a*, a ring-shaped supporting plate 23*a* extending inwardly and horizontally from a bottom end of the wall 21*a*, and a ring-shaped connecting plate 25*a* extending outwardly and horizontally from a top end of the wall 21*a*. A ring-shaped connecting plate 26*a* extends horizontally from a rear end of the connecting plate 25*a*. The connecting plate 26*a* is smaller than the connecting plate 25*a* and tangential to the connecting plate 25*a*, whereby the cover 20*a* substantially forms a bifurcated figure-8 and has a profile similar to that of the housing 11*a*. The wall 21*a* and the supporting plate 23*a* are received in the first chamber 13*a* of the housing 11*a*. A plurality of threaded holes 231*a* is defined in the supporting plate 23*a*. A waterproof cushion 291 is arranged on the supporting plate 23*a*. A plurality of through holes 27*a* is defined in the connecting plates 25*a*, 26*a*. Screws 70 can extend through the holes 27*a* of the connecting plates 25*a*, 26*a* and enter holes 15*a* of the housing 11*a* to fix the cover 20*a* onto the housing 11*a*. An inner edge of the connecting plate 26*a* is depressed downwardly to form a ring-shaped supporting plate 24*a*. Another waterproof cushion 292 is arranged on the supporting plate 24*a*. A round shield 28 covers the supporting plate 24*a* to protect the rectifier 55 received in the second chamber 14*a* of the housing 11*a*.

The heat sink 30*a* comprises a round base 301*a* and a plurality of parallel fins 302*a* extending from a top surface of the base 301*a*. A plurality of through holes 35 are defined in edges of the base 301*a*. Screws 36 can extend through the holes 35 and into the holes 231*a* of the supporting plate 23*a* to fix the heat sink 30*a* to the supporting plate 23*a* of the cover 20*a*.

The LED module 40*a* comprises a plurality of longitudinal boards 401*a* and a plurality of LEDs 402*a* in alignment on each of the boards 401*a*. The LED module 40*a* is attached to a bottom surface of the base 301*a* of the heat sink 30*a*. The reflector 50*a* is mounted on the LED module 40*a* and fixed to the heat sink 30*a*. A plurality of apertures 502*a* is defined in the reflector 50*a*. Each aperture 502*a* corresponds to each LED 402*a*. The lens 60*a* is fixed to the window 130*a* of the housing 11*a*.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. An LED (light emitting diode) lamp, comprising:

a housing defining a window at a bottom end thereof;

a cover covering a top end of the housing, the cover comprising a wall, a connecting plate extending outwardly from an end of the wall and a supporting plate extending inwardly from an opposite end of the wall, the connecting plate engaging the housing, the wall and the supporting plate being completely received in the housing;

a heat sink being supported on the supporting plate of the cover and completely received in the housing; and an LED module attached to the heat sink and facing towards the window of the housing;

wherein the housing substantially forms a bifurcated figure-8 and defines a large chamber and a small chamber therein, the window being defined in the housing corresponding to the large chamber, the heat sink and the LED module being received in the large chamber.

2. The LED lamp as claimed in claim 1, further comprising an additional heat sink received in the small chamber and an additional LED module attached to the additional heat sink, wherein the additional LED module faces an additional window defined in the bottom end of the housing corresponding to the small chamber.

3. The LED lamp as claimed in claim 2, wherein the cover further comprises an additional supporting plate received in the small chamber supporting the additional heat sink thereon, and wherein the supporting plate is received in the large chamber.

4. The LED lamp as claimed in claim 3, wherein the cover substantially forms a bifurcated figure-8, and further comprises an additional wall tangential to the wall and an additional connecting plate extending outwardly from an end of the additional wall, and the additional supporting plate extends inwardly from an opposite end of the additional wall.

5. The LED lamp as claimed in claim 2, further comprising a rectifier received in the small chamber of the housing.

6. The LED lamp as claimed in claim 5, wherein a shield engages the cover and covers the rectifier.

7. The LED lamp as claimed in claim 1, wherein a waterproof cushion is sandwiched between the heat sink and the supporting plate.

8. The LED lamp as claimed in claim 1, further comprising a reflector mounted on the LED module.

9. The LED lamp as claimed in claim 1, further comprising a lens engaging the window of the housing.

10. The LED lamp as claimed in claim 1, wherein a supporting bar extends from an end of the housing, and a through hole is defined in the housing communicating with the housing and the supporting bar.

11. The LED lamp as claimed in claim 10, wherein a waterproof plug is received in the through hole of the housing.

12. An LED lamp, comprising:

a housing defining a small chamber and a large chamber therein, the two chambers communicating with each other, a window being defined in a bottom end of the housing and corresponding to the large chamber;

a cover engaging a top end of the housing;

a heat sink fixed on the cover and received in the large chamber of the housing;

an LED module attached to a bottom surface of the heat sink and facing towards the window of the housing; and a lens engaging with the window of the housing.

13. The LED lamp as claimed in claim 12, wherein the heat sink comprises a base and a plurality of fins extending from the base, and tops of the fins and the top end of the housing are coplanar.

14. The LED lamp as claimed in claim 12, wherein the cover comprises a wall, a supporting plate extending inwardly from a bottom of the wall, and a connecting plate extending outwardly from a top of the wall, the heat sink being arranged on the supporting plate, the wall and the supporting plate being received in the large chamber of the housing, the connecting plate engaging the top end of the housing.

15. The LED lamp as claimed in claim 14, further comprising a rectifier received in the small chamber of the housing for electronically connecting with the LED module, and a shield engaging the cover and covering rectifier.

16. The LED lamp as claimed in claim 12, wherein the cover comprises two tangential walls, two connecting plates respectively extending outwardly from an end of the walls and two supporting plates respectively extending inwardly from an opposite end of the walls, the walls and the supporting plates respectively being received in the chambers, the connecting plates engaging the housing, the heat sink being fixed on one of the supporting plates, the LED lamp further comprising an additional heat sink received in the small chamber of the housing and fixed on another supporting plate of the cover, an additional LED module attached to the additional heat sink, and an additional window defined in the bottom end of the housing towards which the additional LED module faces.

17. An LED lamp, comprising:

a housing defining a window at a bottom end thereof;

a cover covering a top end of the housing, the cover comprising a wall, a connecting plate extending outwardly from an end of the wall and a supporting plate extending inwardly from an opposite end of the wall, the connecting plate engaging the housing, the wall and the supporting plate being completely received in the housing;

a heat sink being supported on the supporting plate of the cover and completely received in the housing; and an LED module attached to the heat sink and facing towards the window of the housing;

wherein a supporting bar extends from an end of the housing, and a through hole is defined in the housing communicating with the housing and the supporting bar.

18. The LED lamp as claimed in claim 17, wherein a waterproof plug is received in the through hole of the housing.

* * * * *